US010548375B2

(12) United States Patent
Greer

(10) Patent No.: US 10,548,375 B2
(45) **Date of Patent: *Feb. 4, 2020**

(54) WRISTBAND WITH CONTOURED COMFORT SIDES

(71) Applicant: LASER BAND, LLC, St. Louis, MO (US)

(72) Inventor: Mark Greer, O'Fallon, MO (US)

(73) Assignee: Zebra Technologies Corporation, Lincolnshire, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/854,550

(22) Filed: Apr. 1, 2013

(65) Prior Publication Data

US 2013/0212919 A1 Aug. 22, 2013

Related U.S. Application Data

(63) Continuation of application No. 11/553,873, filed on Oct. 27, 2006, now Pat. No. 8,424,115.

(51) Int. Cl.
*A44C 5/00* (2006.01)

(52) U.S. Cl.
CPC ..... *A44C 5/0053* (2013.01)

(58) Field of Classification Search
CPC ..... A44C 5/0015; G09F 3/005
USPC ..... 2/16, 59, 60, 162, 170; 40/633; 283/75
See application file for complete search history.

(56) References Cited

U.S. PATENT DOCUMENTS 230,455 A 7/1880 Wilcox
919,983 A 4/1909 Walsh
922,948 A 5/1909 Portmore
1,517,456 A 12/1924 Pulliam
2,054,227 A 9/1936 Nichols
2,073,280 A 3/1937 Lederer
2,300,376 A * 10/1942 Wells, Jr. ..... A41D 19/0044 2/162
2,510,224 A * 6/1950 Hettinger ..... A44C 5/0015 224/219
2,553,676 A 5/1951 Francois
2,641,074 A 6/1953 Richmond
3,197,899 A 8/1965 Twentier
3,402,808 A 9/1968 Yannuzzi
3,660,916 A 5/1972 McDermott et al.
3,854,229 A 12/1974 Morgan
(Continued)

FOREIGN PATENT DOCUMENTS

EP 1039431 9/2000
EP 2132983 A2 * 12/2009 ..... A01K 11/00
(Continued)

OTHER PUBLICATIONS

Avery Dennison DuraCard™.
(Continued)

*Primary Examiner* — Sally Haden

(57) ABSTRACT

A bending yielding feature for use along an edge of any flexible wristband design provides a cushioning effect to a wearer's wrist or ankle as the wristband is worn, thereby helping to prevent injury to the wearer's wrist or ankle as he flexes his wrist or ankle against the wristband. The bending yielding feature can include many edge designs such as a scalloped edge, a curved edge, an edge with a series of extending flaps, and other such shapes.

13 Claims, 5 Drawing Sheets

(56) References Cited

U.S. PATENT DOCUMENTS

| | | | | |
|---|---|---|---|---|
| 4,004,362 | A | 1/1977 | Barbieri | |
| 4,078,324 | A | 3/1978 | Wiebe | |
| 4,179,833 | A | 12/1979 | Knodel | |
| 4,226,036 | A | 10/1980 | Krug | |
| 4,233,715 | A | 11/1980 | McDermott | |
| 4,612,718 | A | 9/1986 | Golub et al. | |
| 4,627,994 | A | 12/1986 | Welsch | |
| 4,682,431 | A | 7/1987 | Kowalchuk | |
| 4,696,843 | A | 9/1987 | Schmidt | |
| 4,783,917 | A | 11/1988 | Smith et al. | |
| 4,829,604 | A | 5/1989 | Allen et al. | |
| 4,854,610 | A | 8/1989 | Kwiatek | |
| 4,855,277 | A | 9/1989 | Walter | |
| 4,914,843 | A | 4/1990 | DeWoskin | |
| 4,941,210 | A | 7/1990 | Konucik | |
| 4,956,931 | A | 9/1990 | Selke | |
| 4,991,337 | A | 2/1991 | Solon | |
| RE33,616 | E | 6/1991 | Welsch | |
| 5,026,084 | A | 6/1991 | Pasfield | |
| 5,045,426 | A | 9/1991 | Maierson et al. | |
| 5,135,789 | A | 8/1992 | Schmidt | |
| 5,222,823 | A | 6/1993 | Conforti | |
| 5,227,004 | A | 7/1993 | Belger | |
| 5,227,209 | A | 7/1993 | Garland | |
| 5,283,969 | A | 2/1994 | Weiss | |
| 5,311,689 | A | 5/1994 | Lindsey | |
| 5,318,326 | A | 6/1994 | Garrison | |
| 5,351,993 | A | 10/1994 | Wright | |
| 5,370,420 | A | 12/1994 | Khatib et al. | |
| 5,383,686 | A | 1/1995 | Laurash | |
| 5,418,026 | A | 5/1995 | Dronzek et al. | |
| 5,427,416 | A | 6/1995 | Birch | |
| 5,486,021 | A | 1/1996 | Laurash | |
| 5,486,436 | A | 1/1996 | Lakes | |
| 5,509,363 | A | 4/1996 | Kohls | |
| 5,509,693 | A | 4/1996 | Kohls | |
| 5,509,694 | A | 4/1996 | Laurash et al. | |
| 5,518,787 | A | 5/1996 | Konkol | |
| 5,524,934 | A | 6/1996 | Schwan et al. | |
| 5,547,227 | A | 8/1996 | Laurash et al. | |
| 5,581,924 | A | 12/1996 | Peterson | |
| 5,586,788 | A | 12/1996 | Laurash | |
| 5,595,404 | A | 1/1997 | Skees | |
| 5,598,970 | A | 2/1997 | Mudry et al. | |
| 5,601,313 | A | 2/1997 | Konkol et al. | |
| 5,630,627 | A | 5/1997 | Stewart | |
| 5,637,369 | A | 6/1997 | Stewart | |
| 5,648,143 | A | 7/1997 | Mehta et al. | |
| 5,653,472 | A | 8/1997 | Huddleston et al. | |
| 5,662,976 | A | 9/1997 | Popat et al. | |
| 5,687,903 | A | 11/1997 | Akridge et al. | |
| 5,758,422 | A * | 6/1998 | Frank | 30/230 |
| 5,765,885 | A | 6/1998 | Netto | |
| 5,842,722 | A | 12/1998 | Carlson | |
| 5,877,742 | A | 3/1999 | Klink | |
| 5,933,993 | A | 8/1999 | Riley | |
| 5,984,363 | A | 11/1999 | Dotson et al. | |
| 6,000,160 | A | 12/1999 | Riley | |
| 6,006,460 | A | 12/1999 | Blackmer | |
| 6,016,618 | A | 1/2000 | Attia et al. | |
| 6,053,535 | A | 4/2000 | Washburn et al. | |
| 6,067,739 | A | 5/2000 | Riley | |
| 6,071,585 | A | 6/2000 | Roth | |
| 6,092,321 | A | 7/2000 | Cheng et al. | |
| 6,155,476 | A | 12/2000 | Fabel | |
| 6,155,603 | A | 12/2000 | Fox | |
| 6,159,570 | A | 12/2000 | Ulrich et al. | |
| 6,303,539 | B1 | 10/2001 | Kosarew | |
| 6,331,018 | B1 | 12/2001 | Roth et al. | |
| 6,343,819 | B1 | 2/2002 | Shiozaki | |
| 6,361,078 | B1 | 3/2002 | Chess | |
| 6,409,871 | B1 | 6/2002 | Washburn et al. | |
| 6,438,881 | B1 | 8/2002 | Riley | |
| 6,510,634 | B1 | 1/2003 | Riley | |
| 6,517,921 | B2 | 2/2003 | Ulrich et al. | |
| 6,611,962 | B2 | 9/2003 | Redwood et al. | |
| 6,685,228 | B2 | 2/2004 | Riley | |
| 6,748,687 | B2 | 6/2004 | Riley | |
| 6,807,680 | B2 | 10/2004 | Sloot | |
| 6,836,215 | B1 | 12/2004 | Laurash et al. | |
| 6,863,311 | B2 * | 3/2005 | Riley | G09F 3/0288 283/101 |
| 7,017,293 | B2 | 3/2006 | Riley | |
| 7,017,294 | B2 | 3/2006 | Riley | |
| 7,047,682 | B2 | 5/2006 | Riley | |
| 7,222,448 | B2 | 5/2007 | Riley | |
| 7,240,446 | B2 | 7/2007 | Bekker | |
| 7,658,026 | B2 | 2/2010 | Jain et al. | |
| 7,658,027 | B2 | 2/2010 | Jain et al. | |
| 7,784,209 | B2 | 8/2010 | Greer | |
| 7,823,310 | B2 | 11/2010 | Jain et al. | |
| 7,877,915 | B2 | 2/2011 | Jain et al. | |
| 8,424,115 | B2 | 4/2013 | Greer | |
| 2002/0176973 | A1 | 11/2002 | Keiser | |
| 2003/0011190 | A1 | 1/2003 | Ryan | |
| 2003/0074821 | A1 * | 4/2003 | Goodin | G09F 3/005 40/633 |
| 2004/0060216 | A1 * | 4/2004 | Riley | B42D 15/00 40/633 |
| 2004/0068906 | A1 | 4/2004 | Riley | |
| 2004/0244251 | A1 | 12/2004 | Riley | |
| 2004/0244451 | A1 | 12/2004 | Riley | |
| 2005/0010993 | A1 * | 1/2005 | Mouritzen | G09F 3/005 2/311 |
| 2005/0108912 | A1 | 5/2005 | Bekker | |
| 2005/0279001 | A1 | 12/2005 | Riley | |
| 2005/0281989 | A1 | 12/2005 | Finger | |
| 2006/0230661 | A1 | 10/2006 | Bekker | |
| 2006/0236578 | A1 | 10/2006 | Saint et al. | |
| 2007/0089342 | A1 * | 4/2007 | Jain | B42D 15/00 40/633 |
| 2008/0098635 | A1 * | 5/2008 | Jain | G09F 3/005 40/633 |

FOREIGN PATENT DOCUMENTS

| | | | | |
|---|---|---|---|---|
| FR | 2806594 | | 9/2001 | |
| GB | 960859 | | 6/1964 | |
| GB | 2045718 | | 11/1980 | |
| GB | 2160492 | | 12/1985 | |
| GB | 2228915 | | 9/1990 | |
| JP | 2002351321 | | 12/2002 | |
| JP | 2003066749 | | 3/2003 | |
| JP | 2003066849 | A | 3/2003 | |
| JP | 2003157010 | | 5/2003 | |
| JP | 2003164307 | | 6/2003 | |
| JP | 2005134839 | A * | 5/2005 | |
| JP | 2006039209 | | 2/2006 | |
| JP | 4450410 | B2 * | 4/2010 | G09F 3/005 |
| JP | 4493820 | B2 * | 6/2010 | G09F 3/005 |
| WO | WO-96/12318 | | 5/1996 | |
| WO | WO-98/23081 | | 5/1998 | |
| WO | WO-99/18817 | | 4/1999 | |
| WO | WO-02/039412 | | 5/2002 | |
| WO | WO-03/003331 | | 1/2003 | |
| WO | WO-04/028826 | | 4/2004 | |
| WO | WO-05/064574 | | 7/2005 | |
| WO | WO-06/007356 | | 1/2006 | |
| WO | WO-07/021375 | | 2/2007 | |
| WO | WO-07/133906 | | 11/2007 | |

OTHER PUBLICATIONS

Avery® Laminated Identification Cards #5361.

Berry, G., "*Wrist Watch*;" Advance for Healthcare Information Professionals; dated Feb. 15, 1999.

Brochure entitled: "*Color-Bar® Click Stip™ Label System*;" Smead Manufacturing Company; date unknown; Form No. SSS-CS-00.

Brochure entitled: "*Color-Bar® Folders*;" Smead Manufacturing Company; date unknown.

Brochure entitled: "*Integrated Document Management Software*;" Smead Manufacturing Company; date unknown; Form No. SLI-95.

(56) References Cited

OTHER PUBLICATIONS

Catalog entitled: "*Reseller Catalog Number One*;" Smead Software Solutions™; Date unknown; Form No. SSS-RC1-00.
*Posey Moveable I.D. Bracelet*; retrieved on Aug. 18, 2004 from <http://www,posey.com/products/4648.html>.
*Stock Vinyl Writsband*: Wb1908; ID Warehouse; retrieved on Jan. 31, 2005 from <http:web.archive.org/web/20050131235601/http://idwarehouse.com/>; p. 1.
Sample of Standard Register Label.
Sample of Standard Register Labels.
Standard Register; P.S. Magazine; dated Fall 2008; Dayton, Ohio.
"*Triage Tag*;" Disaster Management Systems, Inc.; dated 1996; Ponoma California.
"*Triage Tag*;" Maryland Department of Transportation, Maryland Emergency Medical Services; dated 1999; Maryland.
"*Yes, Sir, That's My Baby!*;" Material Management in Health Care, vol. 8, No. 2; dated Feb. 1999; Health Forum Inc.
International Search Authority, "Written Opinion," dated Apr. 27, 2009 in connection with PCT/US2007/078924.
International Search Authority, "International Search Report," dated Apr. 27, 2009 in connection with PCT/US2007/078924.

* cited by examiner

WRISTBAND WITH CONTOURED COMFORT SIDES

CROSS-REFERENCE TO RELATED APPLICATIONS

This application is a continuation of U.S. application Ser. No. 11/553,873, filed Oct. 27, 2006, the entire contents of which are incorporated herein by reference.

BACKGROUND AND SUMMARY OF THE INVENTION

Wristbands for use in admitting and identifying patients for both in patient and out patient care are routinely used in the medical community today. The assignee hereof owns a number of patents disclosing and claiming various inventive wristband suited to this medical field application, and which have experienced great commercial success. Examples of these include U.S. Pat. Nos. 5,933,993; 6,000,160; 6,067,739; 6,438,881; 6,510,634; 6,748,687; 7,047,682; 7,017,293; and 7,017,294, the disclosures of which are incorporated herein by reference. These patented wristbands have been made and sold by the millions. Some are sized for use on adults and others are sized for use on infants and even newborns having the smallest of wrists or ankles. The wristband designs shown in these prior patents have straight edges along their length, and they have been accepted as safe and comfortable for all their intended users. Nevertheless, as demonstrated by the continuing series of patent filings, the assignee has endeavored to continuously improve its wristband designs to the continuing benefit of the consuming public.

In many wristband designs, especially in those wristbands which are thin, an edge is created along its length which, for wearers with sensitive skin such as newborn babies, or should the wristband be inadvertently applied too tightly about the wearer's wrist or ankle, could actually create an abrasion or even a fine cut (like a paper cut) in the wearer's wrist or ankle. For newborns, some of whom have wristbands placed on both ankles, the wristband on the right leg could cause an abrasion or cut on the left leg as the baby thrashes about, and vice versa. While these instances are rare, and would ordinarily be avoided by a careful and attentive medical staff, it does provide an opportunity for improvement. It is noted that for convenience the word "wrist" is intended to refer to any limb and the phrase "wristband" is intended to refer to a band worn around any limb.

As a result of the assignee's continuing efforts to improve these wristband designs, the inventor herein has succeeded in designing an improvement which increases the comfort, and reduces the risk of harm, for not only the assignee's designs but also virtually all other flexible wristbands. In simple terms, the inventor has succeeded in developing a "bending yielding feature" for softening the edge pressure exerted by the edges of the wristband to the wearer's wrist or ankle. This bending yielding feature is especially useful for wristband designs in popular use today which are made of flexible vinyl or other thin plastic laminates. These materials are quite strong which allow them to be made from especially thin or lightweight plies, thereby increasing the likelihood that they exhibit a sharp edge which when pressed against the wrist or ankle is likely to cut or abrade it.

In simple terms, a "bending yielding feature" can be understood as any design that, inter alia, essentially adds "yieldability", adds flex, or presents a smooth surface to a wearer's skin. In essence, a non-linear edge would seem to the inventor to satisfy this requirement. Examples of this feature include a scalloped edge design, a "toothed" edge design, a "slotted" edge design, a "folded over" edge design, and other "non-straight" edges. Some of these designs extend the length of the edge to be longer than a straight line measurement. Others of these designs provide design elements that are more flexible than a simple straight edge would provide. Still others, such as a folded over edge, provide an actual cushion at the edge which comes into contact with the wearer's wrist as the wrist is flexed or ankle as it is flexed. All are enough to help prevent a sharp edge from coming into contact with the wearer's wrist or ankle as the wrist or ankle is flexed.

In some wristband designs, there is an information receiving area or panel of the wristband that is usually wider (but need not be) than a strap portion or otherwise designated to receive information. For those designs having one portion of the wristband wider than other portions, it is considered preferable that the bending yielding feature be applied along the wider portion as that portion is normally the part of the wristband that comes into contact with the wrist or ankle first. It is also considered preferable that the bending yielding feature be formed along substantially the entire length of both opposing sides of the wider panel portion. Should there be no portion wider than another, as is the case for some designs shown in the assignee's patents identified above, then it is considered preferable that the bending yielding feature be formed along substantially the entirety of at least one side of the length that ordinarily would come into contact with a wearer's wrist or ankle as the wristband is worn and the wrist or ankle is flexed. However, forming the feature in both sides is considered to also be beneficial and is intended as one embodiment of the present invention.

While the principal advantages and features of the invention have been described above, a greater understanding may be attained by referring to the drawings and detailed description of the preferred embodiment that follows.

DETAILED DESCRIPTION OF THE PREFERRED EMBODIMENT

An example disclosed self-laminating wristband includes an information receiving ply, a laminating ply for overlying said information receiving ply and substantially encapsulating it, said laminating ply having at least one tab at its end for attaching the wristband to a wearer's limb, and at least the laminating ply having a bending yielding feature along at least part of its length. An example disclosed self-laminating wristband includes an information receiving ply, a clamshell laminating ply for folding over and substantially encapsulating the information receiving ply, and a strap portion integrally formed with said clamshell laminating ply, said clamshell laminating ply having a bending yielding feature extending along at least part of its length adjacent the information receiving ply.

Figure 1:
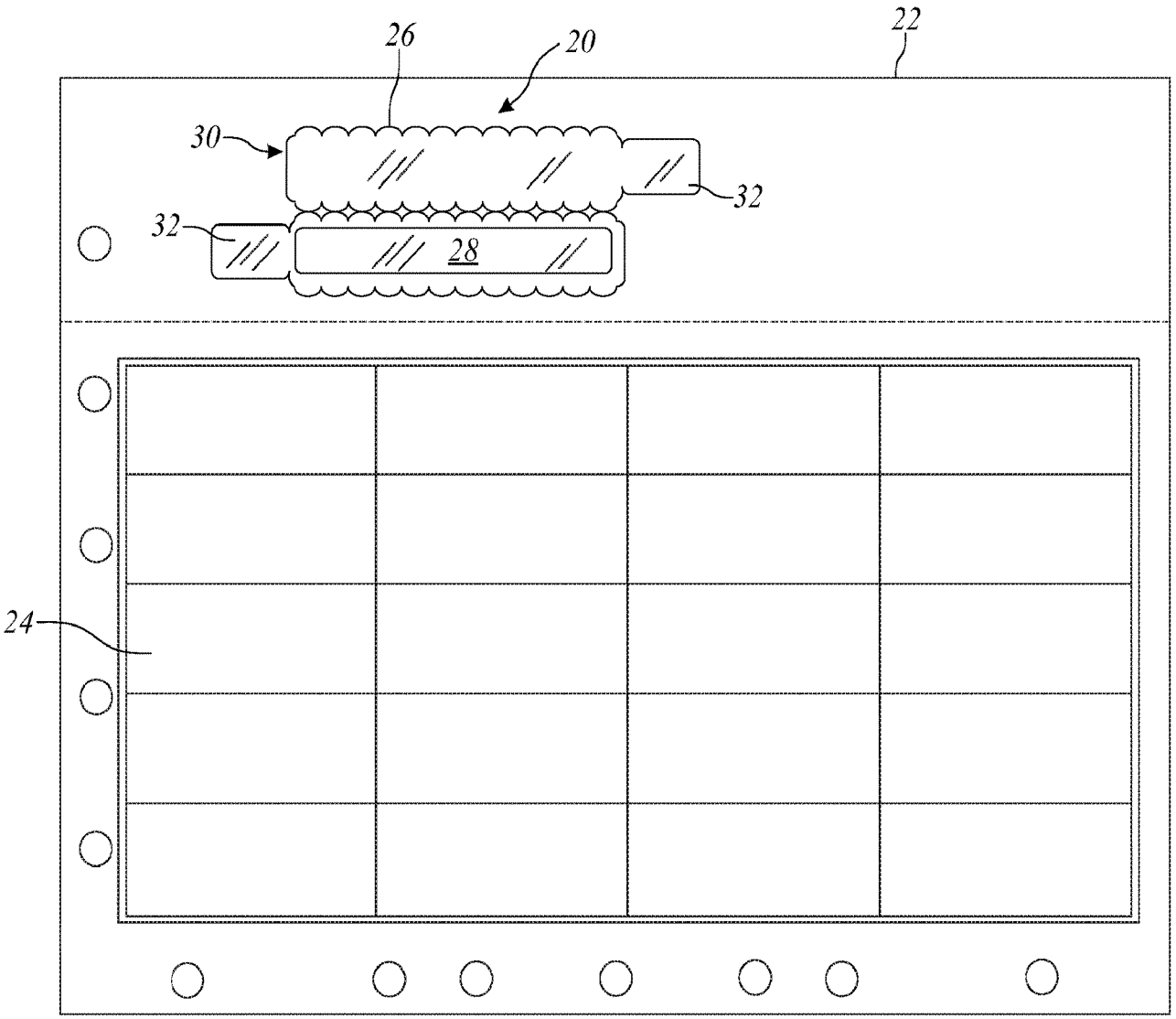
FIG. 1 is a plan view of a business form comprising a wristband and label sheet, with the wristband having a bending yielding feature formed along the length of an information receiving panel.

As shown in FIG. 1, the first patented wristband design 20 as included on a page sized sheet 22 along with a matrix of self adhering labels 24 may be readily adapted for application of the bending yielding feature 26 of the present invention. The wristband design 20 includes an imaging or printable face stock area 28 upon which is printed a patient's name, attending doctor's name, a bar code, etc. and then a clamshell lamination ply 30 is folded over to substantially encapsulate the face stock area 28 with a pair of integrally formed self adhering tabs 32 used for attaching the wristband to the patient. This construction is described in greater detail in several of the patents mentioned above.

The bending yielding feature 26 is shown as preferably being a scallop shaped design although any of the other designs shown in FIGS. 4A-E could be used as well. The scallop shaped design presents a design that is visually pleasing, does not create any "loose ends" as in other designs which might either separate or be caught in something as the limb is moved about, minimizes the chances for developing a crease or sharp edge, and which also distributes the load across a larger surface area. It is noted that the bending yielding feature 26 provides some "give" should either edge come into contact with the wearer's wrist or ankle as the wristband is worn. Although the inventor has not yet conducted testing to ascertain the optimal angles, degree of curvature, etc. as would yield best results, the inventor does believe that different radius of curvature would be appropriate depending on the length of the wristband on which a scallop design would be used. For a shorter wristband, it is anticipated that a smaller radius of curvature and hence greater periodicity of the yielding feature would be desirable.

Figure 2:
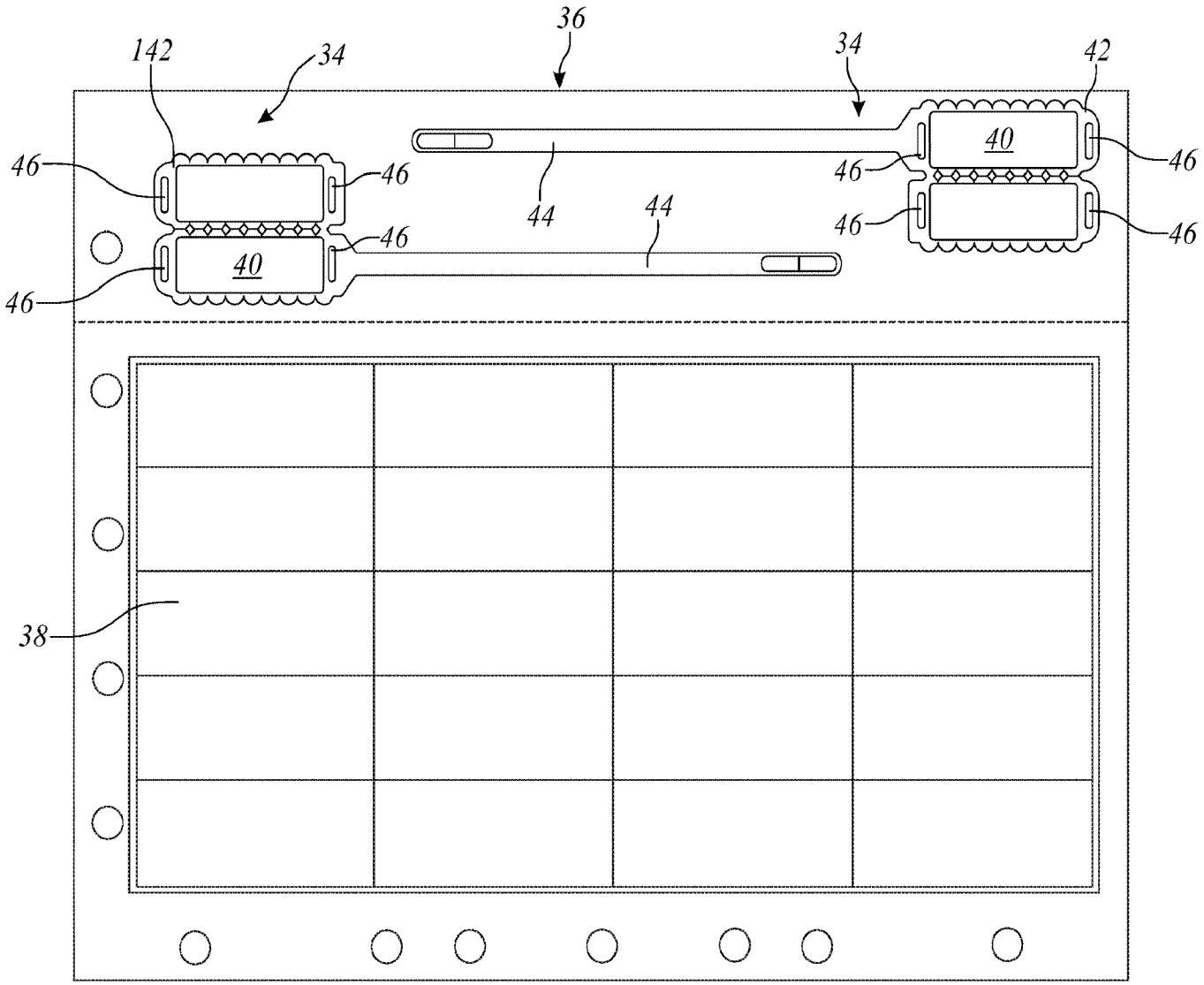
FIG. 2 is a plan view of a business form comprising a wristband and label sheet, with the wristband having a bending yielding feature formed along the length of an information receiving panel.

As shown in FIG. 2, the second patented wristband design 34 as included on a page sized sheet 36 along with a matrix of self adhering labels 38 may also be readily adapted for application of the bending yielding feature 26 of the present invention. This wristband design 34 also includes an imaging or printable face stock area 40 although the area 40 does not extend the full length of the wristband 34, and a clamshell lamination ply 42 having an information receiving portion 45, a narrower strap 44 and one or more cinch slots 46 are used to attach the wristband onto a patient's wrist or ankle. In this design, as a patient flexes his wrist or ankle, it is thought that the edges of the clamshell 42 adjacent the imaging area 40 are much more likely to come into contact with the patient and hence it is preferred that just these edges receive the bending yielding feature 26.

The bending yielding feature 26 is similarly shown as a scallop design although other designs could be used as well.

Figure 3:
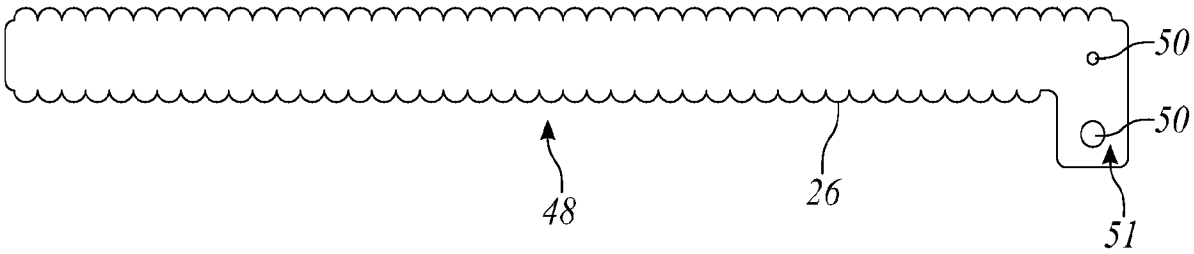
FIG. 3 is a plane view of a wristband with a bending yielding feature found along both sides thereof.

FIG. 3 discloses a straight wristband 48, with no panel or designated information receiving area, in which the bending yielding feature 26 is provided along a substantial portion of one longitudinal edge thereof. The wristband 48 defines a closure portion 51 at one of its ends. The particular design shown also has a snap closure 50 at its end, although any suitable closure could be used as known by those of skill in the art. As mentioned herein, this bending yielding feature 26 may extend along substantially the entirety of the length of the band, or along only a relatively short portion of the length and just enough to soften the impact of the band as it comes into contact with the wearer's limb.

Figure 4A:
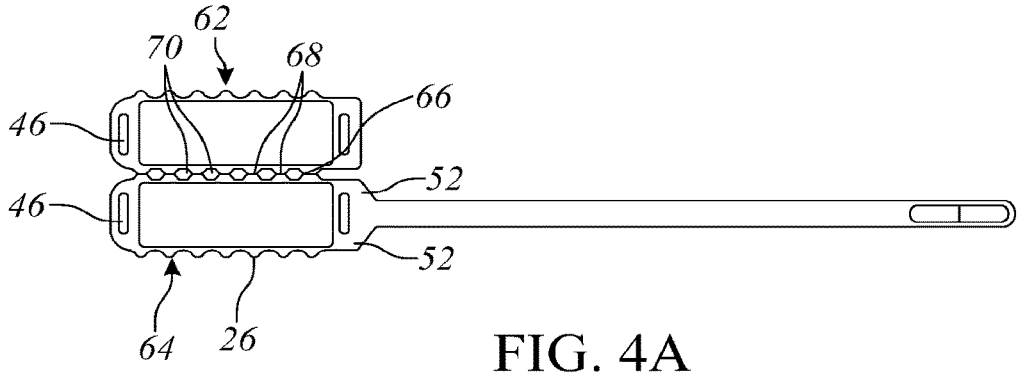
FIGS. 4A-E are a series of top views each depicting a different embodiment of a bending yielding feature.
Figure 4B:
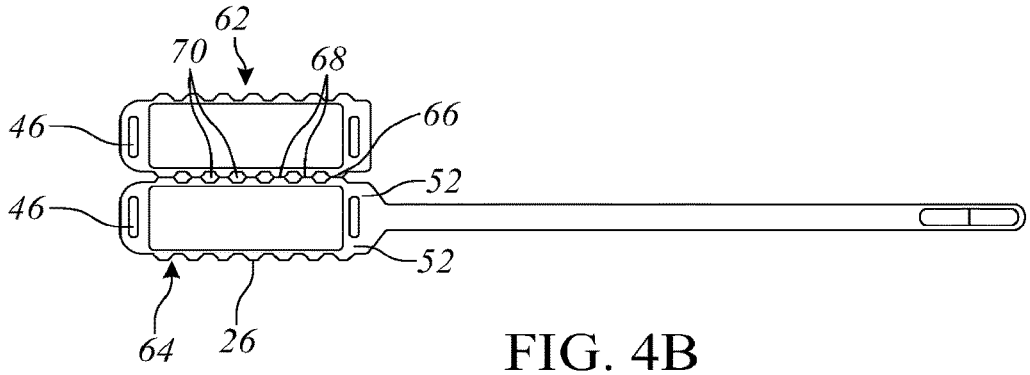
Figure 4C:
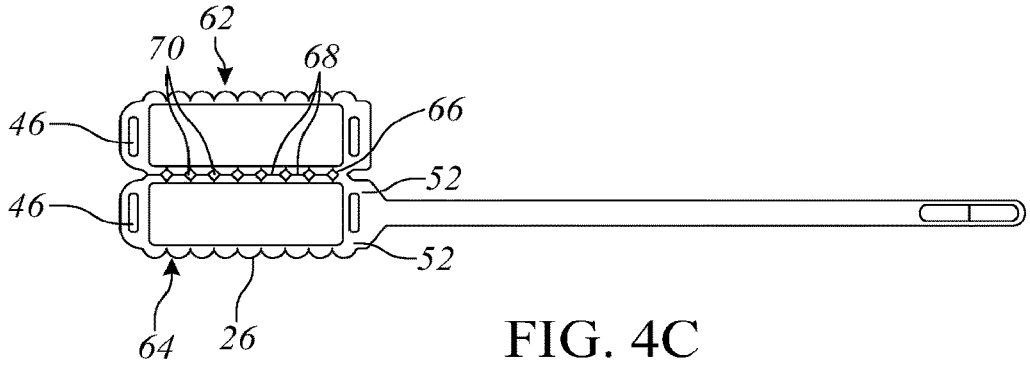
Figure 4D:
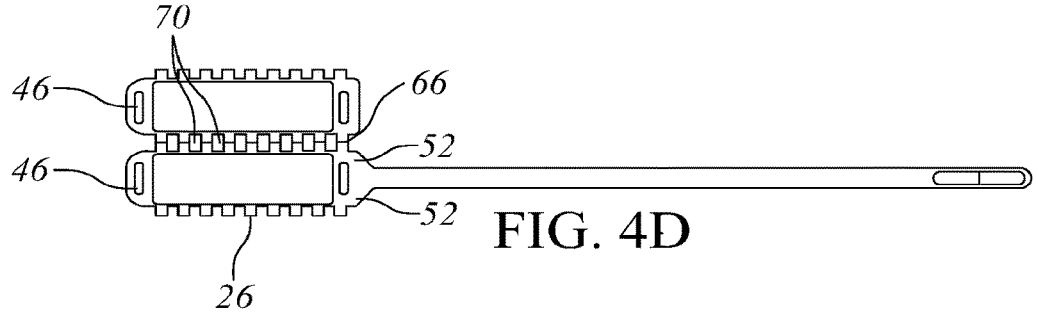
Figure 4E:
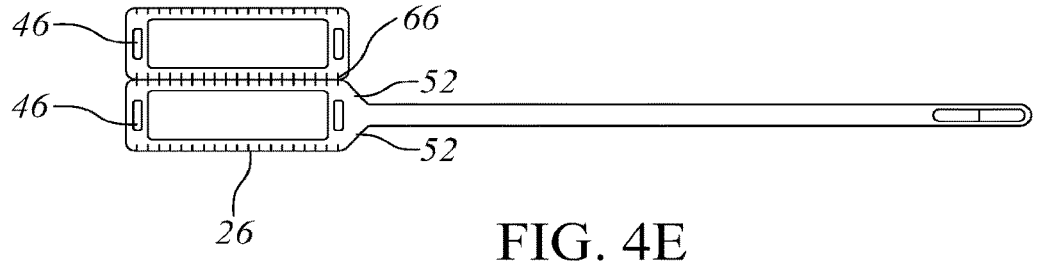

FIG. 4A-E depict different shapes and designs for the bending yielding feature 26 which are all believed to exhibit the desired effect, i.e. that of softening or making it more yielding or lengthening the edge to increase the comfort of the wearer. As shown in FIG. 4A, the bending yielding feature 26 may be shaped as a generous curve or scallop, preferably extending from near the front shoulder 52 of both halves of the clamshell 42 to end near the outboard cinch slot 46. As shown in FIG. 4B, the bending yielding feature 26 may be shaped as more pronounced and regular, with flattened pyramids extending outwardly. As shown in FIG. 4C, the bending yielding feature 26 may be shaped as a continuous half or semi-circle pattern, resembling an arrangement of petals along the edge. As shown in FIG. 4D, the bending yielding feature 26 may be shaped as a Greek key, or series of spaced rectangular flaps. As shown in FIG. 4E, the relieved edge may be formed by a series of die cuts which creates a series of adjacent rectangular flaps. Examples shown in FIGS. 4A-C include a first plurality of scallops 62 and a second plurality of scallops 64. The first plurality of scallops 62 and the second plurality of scallops 64 are disposed on edges opposite each other, separated by a fold line 66. A plurality of cutouts 68 (two cutouts of the plurality are indicated in FIGS. 4A-C, which does not indicate that there are only two in the plurality, rather only two are noted to increase clarity) is disposed along the fold line 66. Each of the plurality of cutouts 68 is an area of the ply in which the laminated material is diecut from the wristband material. In the examples of FIGS. 4A-C, a third plurality of scallops 70 (two scallops of the plurality are indicated in FIGS. 4A-C, which does not indicate that there are only two in the plurality, rather only two are noted to increase clarity) is created by the clamshell laminating ply in the space around the cutouts 68 along the fold 66. The third plurality of scallops 70 is positioned such that when the clamshell laminating ply bends along the fold line 66, and the first plurality of scallops 62 come in contact with the second plurality of scallops 64, the third plurality of scallops 70 are formed.

Figure 5:
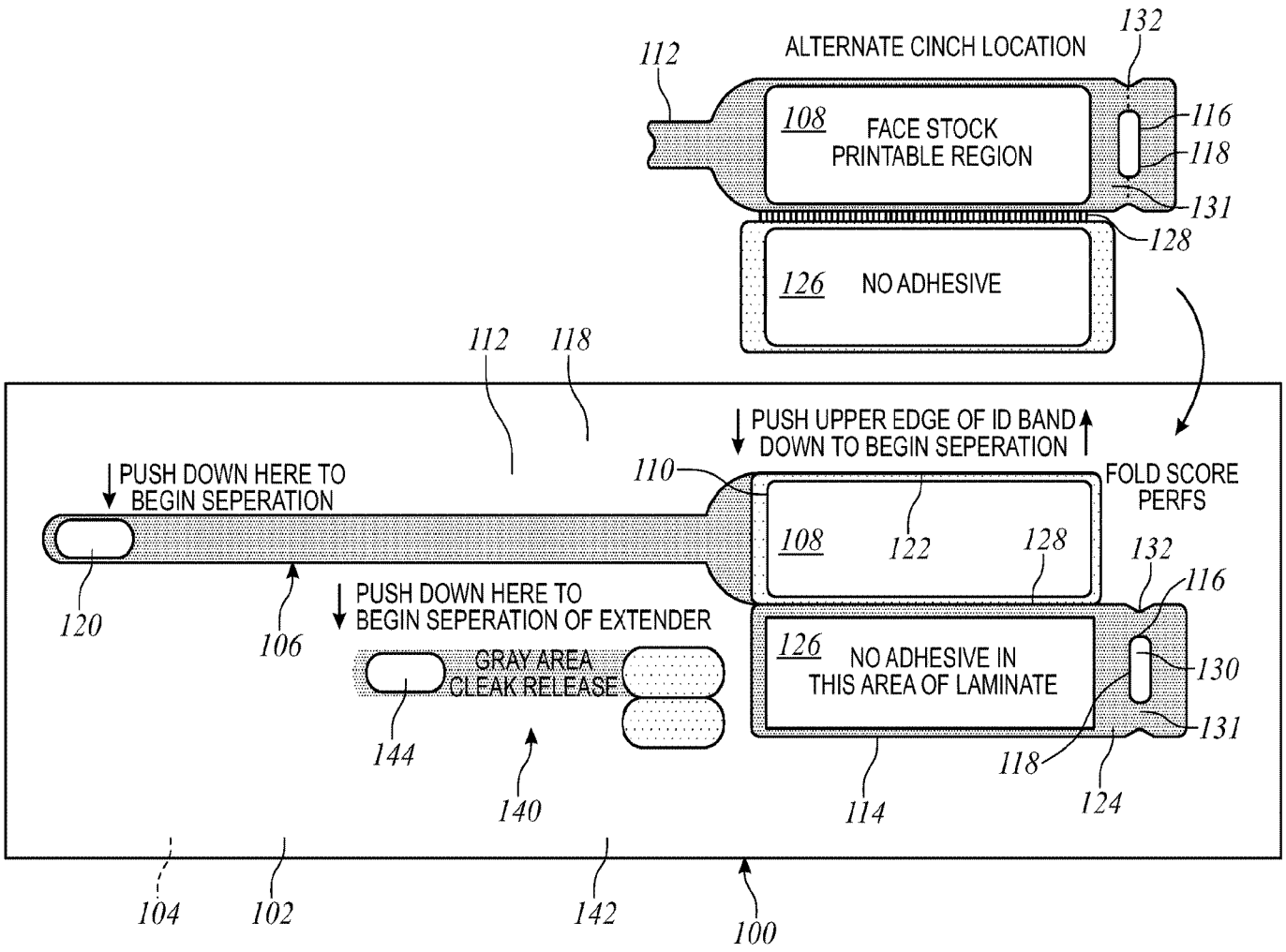
FIG. 5 PRIOR ART
FIG. 5 is a top view of an example self-laminating wristband.

The present invention 100 is shown in FIG. 5 and is depicted therein as formed in a two layer, sheetlet sized construction of about 3 inches by 11 inches. The top layer 102 is preferably a face stock, such as bond or the like as would readily accept a printed image from a laser printer or other computer controlled printer, and a bottom laminate layer 104 which underlies the face stock layer 102 and is joined by a patterned adhesive layer including portions which are release coated, as will become apparent upon further reading. The invention 100 generally comprises a self laminating wristband 106 having a printable region 108 of face stock defined by a die cut 110 therein, and an integrally formed strap portion 112, laminating portion 114, and cinch 116 similarly formed by a die cut 118 in the laminate layer 104. A patch of face stock 120 is also die cut into the face stock layer 102, and covers a patch of adhesive with which the strap portion is adhered as the wristband 106 is applied to a patient, as will be explained. The length of strap portion 112 is covered by a release coating so that after it is removed from the sheetlet 100 it does not carry any adhesive with it. The laminating portion 114 has a layer of adhesive between a top portion thereof 122 and the face stock region 108 to adhere it thereto. However, a bottom portion 124 of the laminating portion 114 has a window 126 of area where no adhesive is applied so that as the laminating portion is folded over there is no layer of adhesive covering the printable region 108. A fold or perf line 128 if formed between the laminating portion halves 122, 124 as an aid in forming the wristband 106 after it is separated from the sheetlet 100. The cinch 116 generally comprises a slot 130 formed in an extension 131 and aligned generally perpendicularly to the face stock region 108 and strap portion 112 for easy insertion of the strap portion 112 therethrough. There is also provided a fold or perf line 132 along the central axis of the slot 130 through the width of the extension 131, and adhesive covers the extension 131 so that the extension 131may be folded over onto the strap portion 112 after it has been threaded through the slot 130 to its desired length. The extension 131 and cinch 116 are shown to be adjacent the bottom half 124 of laminating portion 114, which results in the adhesive layer of the extension 131 facing towards the patient's wrist as the wristband is applied. Alternatively, the extension 131 and cinch 116 may be formed adjacent the top half 122 of the laminating portion 114 as shown in the inset of FIG. 9 and with this construction the extension adhesive faces away from the patient as the wristband is applied. With this alternative arrangement, the wristband may lie flatter against the patient, as the other arrangement creates a small tab which may or may not lie flat depending on how tight the wristband is drawn. However, this is not considered significant.

In use, this wristband embodiment is first separated from the carrier sheetlet by pushing down on the end of the strap and/or the die cut face stock area 108, and peeling it away, thereby separating a matrix comprising the wristband assembly. The laminating portion 114 is then folded together to enclose the printed face stock region. The wristband is next applied to the patient's wrist by wrapping the strap about the wrist, inserting it through the cinch, folding over the extension to adhere it to the strap, and then exposing the adhesive on the end of the strap and adhering it back onto itself to secure the excess strap. The caregiver can chose the tightness of the wristband by threading more or less of the strap through the slot in the cinch before adhering the strap to the extension.

Although a number of arrangements and designs are explicitly shown herein for the bending yielding feature, one of skill in the art would find other arrangements and designs apparent from the teaching provided. For example, a folded edge design might also be provided which would in effect provide a "bumper" to cushion the wristband against the wearer's wrist or ankle. Other designs would also be apparent and are intended to be included within the scope of the invention. Accordingly, the present invention is disclosed herein in terms of its preferred embodiment solely to be illustrative and not limiting in any way. Instead, the scope of the present invention should be limited solely by the legal scope of the claims and their equivalents.

What is claimed is:

1. A wristband, comprising:

an imaging area suitable for receipt of printed information;

a clamshell laminating ply including:

a first end, an opposing second end, a first side edge, a second side edge opposite the first side edge, and a fold defined between the first and second opposing side edges and extending from the first end to the second end, wherein:

the clamshell laminating ply is configured for folding over at the fold to bring the opposing first and second side edges into contact and substantially encapsulate at least a portion of the imaging area, and when the clamshell laminating ply is folded at the fold, the first side edge is brought into contact with the second side edge;

a first bending yielding feature defined by (i) a first plurality of scallops extending at least partially along the first side edge and (ii) a second plurality of scallops extending at least partially along the second side edge; and a second bending yielding feature defined by a plurality of cutouts extending at least partially along the fold, the plurality of cutouts configured to form a third plurality of scallops at the fold when the clamshell laminating ply is folded over at the fold to bring the first side edge and the second side edge into contact, wherein at least one of the plurality of cutouts is enclosed by the clamshell laminating ply when the clamshell laminating ply is in an unfolded state; and a strap portion extending from the first end and configured to engage the second end, wherein said strap portion and the clamshell laminating ply are formed by a single ply.

2. The wristband of claim 1, wherein the first bending yielding feature extends along substantially the entirety of the first side edge.

3. The wristband of claim 1, wherein the strap portion comprises a width that is no wider than the imaging area or the clamshell laminating ply.

4. The wristband of claim 1, further comprising a snap closure.

5. The wristband of claim 1, further comprising cinch slots at the second end configured to receive the strap portion.

6. The wristband of claim 1, wherein each of the first, second and third pluralities of scallops have a shape configured to provide for increased comfort against skin of a wearer of the wristband.

7. The wristband of claim 1, wherein the imaging area is wider than the strap portion.

8. The wristband of claim 1, wherein the plurality of cutouts has peripheries that are entirely enclosed by the clamshell laminating ply.

9. A wristband, comprising:

an imaging area suitable for receipt of printed information;

a clamshell lamination ply having a first end, an opposing second end, a first longitudinal side edge, an opposing second longitudinal side edge, and a fold defined between the first longitudinal side edge and second longitudinal side edge and extending from the first end to the second end, wherein the clamshell lamination ply is configured for folding over at the fold to bring the first longitudinal side edge and the second longitudinal side edge into contact, wherein when the clamshell lamination ply is folded at the fold, the first longitudinal side edge is brought into contact with the second longitudinal side edge;

a first bending yielding feature defined by (i) a first plurality of scallops extending at least partially along the first longitudinal side edge, and (ii) a second plurality of scallops extending at least partially along the second longitudinal side edge;

the clamshell lamination ply comprising a plurality of cutouts extending along the fold, wherein the cutouts are shaped to form a second bending yielding feature having a third plurality of scallops at the fold when the clamshell lamination ply is folded over at the fold to bring the first longitudinal side edge and the second longitudinal side edge into contact, wherein at least one of the plurality of cutouts is enclosed by the clamshell lamination ply when the clamshell lamination ply is in an unfolded state;

a first tab extending from the first end between the fold and the first longitudinal side edge; and a second tab extending from the second end between the fold and the second longitudinal side edge, wherein the first and second tabs are configured to couple the first end to the second end.

10. The wristband of claim 9, wherein the first tab comprises an adhesive.

11. The wristband of claim 9, wherein the imaging area is wider than each of the first tab and the second tab.

12. The wristband of claim 9, wherein each of the first, second and third pluralities of scallops have a shape configured to provide for increased comfort against skin of a wearer of the wristband.

13. The wristband of claim 9, wherein the plurality of cutouts has peripheries that are entirely enclosed by the clamshell lamination ply.

* * * * *